United States Patent [19]

Lindenmüller et al.

[11] 4,143,684

[45] Mar. 13, 1979

[54] PROCESS AND APPARATUS FOR REED-BEATING AND CUTTING OFF FILLINGS INSERTED INTO THE SHED IN SHUTTLELESS WEAVING MACHINERY EQUIPPED WITH WEFT MIXERS

[75] Inventors: Walter Lindenmüller; Erich Peter, both of Lindau, Fed. Rep. of Germany

[73] Assignee: Lindauer Dornier Gesellschaft mbH, Fed. Rep. of Germany

[21] Appl. No.: 826,737

[22] Filed: Aug. 22, 1977

[30] Foreign Application Priority Data

Nov. 13, 1976 [DE] Fed. Rep. of Germany ..... 2651875

[51] Int. Cl.[2] ..... D03D 47/34

[52] U.S. Cl. ..... 139/450; 139/453; 139/302

[58] Field of Search ..... 139/429, 430, 450, 453, 139/302, 303

[56] References Cited

U.S. PATENT DOCUMENTS

| | | | |
|---|---|---|---|
| 3,487,436 | 12/1969 | Svaty et al. | 139/450 |
| 3,960,186 | 6/1976 | Wheeler | 139/450 |

FOREIGN PATENT DOCUMENTS

| | | | |
|---|---|---|---|
| 2509664 | 9/1976 | Fed. Rep. of Germany | 139/453 |
| 60276 | 11/1968 | German Democratic Rep. | 139/450 |
| 182366 | 4/1936 | Switzerland | 139/303 |

*Primary Examiner*—Henry Jaudon

*Attorney, Agent, or Firm*—James E. Bryan

[57] ABSTRACT

This invention relates to an improvement in the process for beating up and cutting off fillings inserted into the shed in shuttless weaving equipment provided with weft mixers, in particular in weaving machinery with filling insertion by means of grippers advancing into and retracting from the shed, the inserted filling being cut off on the insertion side outside the selvage, the improvement comprising that simultaneously with or following the beating up of the last inserted filling: (a) cutting off the previously inserted filling and seizing the free end, connected to a supply spool, by a holding system, (b) guiding the last inserted filling over the back of a scissor blade facing the shed to a catching hook mounted outside the scissors, (c) simultaneously with the back-motion of the shed, displacing the scissors transversely to the direction of the filling in an orthogonal plane and reopening them, the last inserted filling passing from the back of the scissor blade in front of the other scissor blade into the cutting position determined by the catching hook, and (d) guiding back the last inserted filling, by the scissors, into its initial position between the opened scissor blades. The invention also relates to an apparatus for performing the process.

10 Claims, 19 Drawing Figures

FIG. 2C
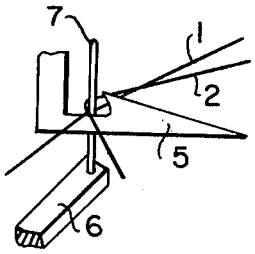
FIG. 2D
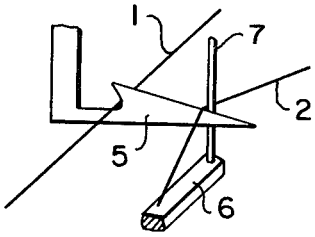
FIG. 3A
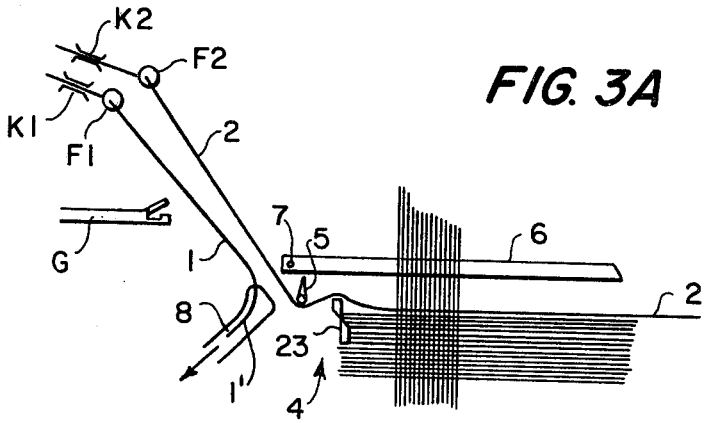
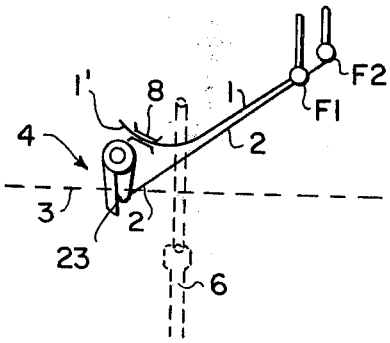
FIG. 3B
FIG. 3C
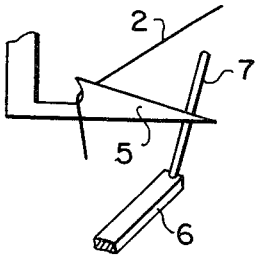

FIG. 4A
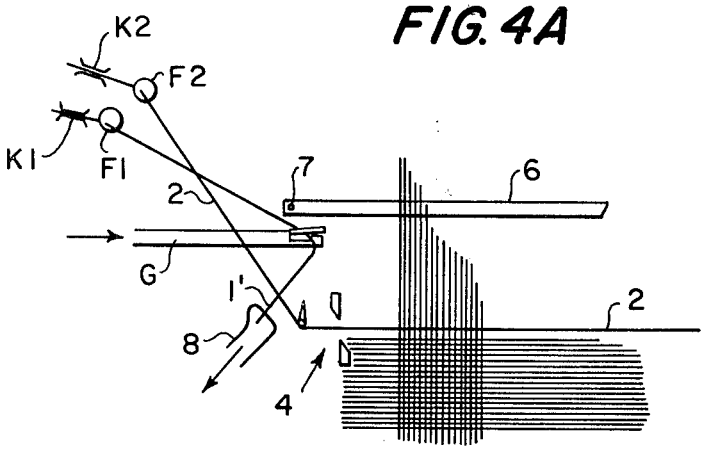
FIG. 4B
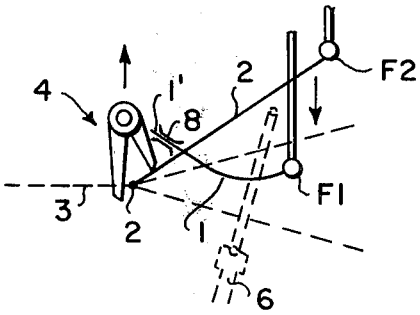
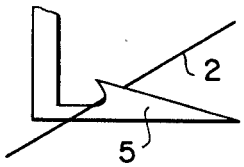
FIG. 4C
FIG. 5A
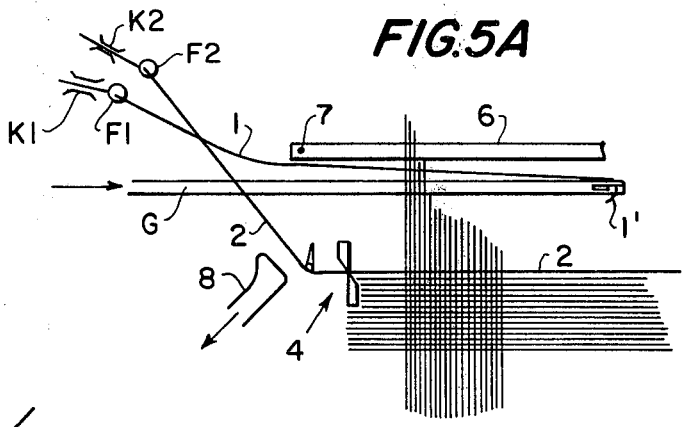
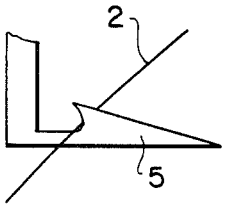
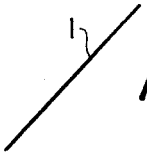
FIG. 5C

PROCESS AND APPARATUS FOR REED-BEATING AND CUTTING OFF FILLINGS INSERTED INTO THE SHED IN SHUTTLELESS WEAVING MACHINERY EQUIPPED WITH WEFT MIXERS

This invention relates to a process and equipment for reed-beating and cutting off fillings inserted into the shed in shuttleless weaving machinery equipped with weft mixers.

It is essential with respect to shuttleless weaving machinery that the free end of the filling connected to the supply spool be kept in a definite position until it is flawlessly seized by the gripper component for filling insertion. Difficulties are encountered when the operation must take care not only of a single but of different fillings. As regards weft mixers where two different fillings must be processed in alternating sequence, care must be exerted that alternatingly one and the other thread be brought into the proper position for the gripper, which is always at the same place when the thread must be seized. This would require a special and movable holding system for each of the two fillings, the holding systems being alternatingly shifted into the prescribed position so the thread can be offered to the gripper. In this procedure, the two fillings would temporarily cross between the holding system and the supply spool.

The following operation has been conventional, namely when cutting off a single filling in shuttleless weaving machinery; if no special measures are taken to reduce or minimize filling waste, the last reed-beaten filling remains connected with the supply spool until there is renewed insertion. Upon new insertion, the filling is cut off at that time from the selvage when the gripper arrives at the height of the filling scissors. These are near the gripper. When steps are taken to prevent waste at filling insertion, the last inserted filling extends from the reed beat-up point at the selvage over a holding system to the supply spool. The thread is cut off close against the selvage prior to seizure by the gripper's clamp for new filling insertion, and the thread end held in the holding system is seized by the opened gripper clamp and looped to such an extent that a thread end of fixed length protrudes from the gripper clamp. The thread segment extending from the gripper clamp to the supply spool is held by a spatially fixed and controlled clamp during this looping.

Such a procedure however may not be transferred to weft mixers. It is furthermore important in this respect that the filling waste be minimized, i.e., the inserted thread must be cut so close to the selvage that only a minute thread end protrudes like a fringe. On the other hand, the cutting should take place in such a manner that the gripper is capable of seizing the free thread end connected to the supply spool very close to the end thereof.

The invention addresses the problem of providing a process allowing the use of weft mixers also with shuttleless weaving equipment while nevertheless avoiding the expense of separate, and furthermore also movable, holding systems for the free filling ends. This problem is solved by the invention with respect to shuttleless weaving machinery in which filling insertion takes place by means of grippers moving into or out of the shed and where the inserted filling is cut off at the insertion side outside the selvage by a process in which at the time of or after reed-beating the last inserted filling (a) the previously inserted filling is cut off and its free end connected to the supply spool is seized by a holding system, (b) the last inserted filling is guided over the back of the scissor blade facing the shed to a catching hook mounted outside the scissors, (c) the scissors are displaced in a vertical plane transversely to the filling direction upon the reverse motion of the fabric edge and are opened again, the last inserted filling passing from the back of the scissor blade in front of the cutting edge of the other scissor blade into the cutting position determined by the catching hook, and (d) the scissors enclose the last inserted filling between their opened blades and so are guided back to their position.

Equipment for implementing the process comprises the following:

(a) a scissors control system imparting to the scissors the cutting motion and a motion in a plane normal to the fabric and to the filling direction as a function of reed motion, (b) a catching hook mounted solidly to the machine outside the scissors, for that part of the inserted filling leading to the supply spool, (c) a member moving with the reed and placing the last inserted filling into the catching hook, and (d) a holding system seizing the free end of the filling connected to the supply spool.

The invention allows operating weft mixers also in shuttleless weaving machinery without requiring two separate holding systems for the free filling ends. Rather, one and the same holding system alternatingly holds either filling. Crossing of the fillings when advancing for thread seizure by the gripper is eliminated. Whereas previously the fillings always were cut when beat up by the reed and then were fed again to the gripper, the invention row delays the time of cutting. The special advantage of the invention is that the beat-up filling initially remains connected with its supply spool for the time of the filling insertion of the subsequent thread and is cut off directly at the selvage only shortly before this first thread is gripped again. The filling holding time therefore is practically twice the earlier value. No catching selvage is required for the inserted fillings. The elimination of catching selvages results in considerable savings in material. Errors in feeding and seizing the fillings to be inserted are eliminated. The holding system alternatingly used for both fillings of the weft mixers may be mounted fixed in position and does not require being brought into the proper position every time a filling is advanced.

The basic concept of the process and an implementing example of equipment for this process are discussed below with reference to the accompanying drawings, in which:

FIGS. 1A through 5C show the beat-up process of the fillings in various process stages in time-sequence;

The invention will be illustrated below in relation to an example of two alternatingly inserted fillings. Obviously the invention also may be used for double fillings in an alternating sequence or for combining single and double fillings in an alternating sequence.

Partial FIGS. a) and b) in FIGS. 1 through 5, respectively, show top views of the fabric-edge and side views of the shed, and partial FIGS. c) and d) are perspectives of the filling at the fabric edge.

Figure 1A:
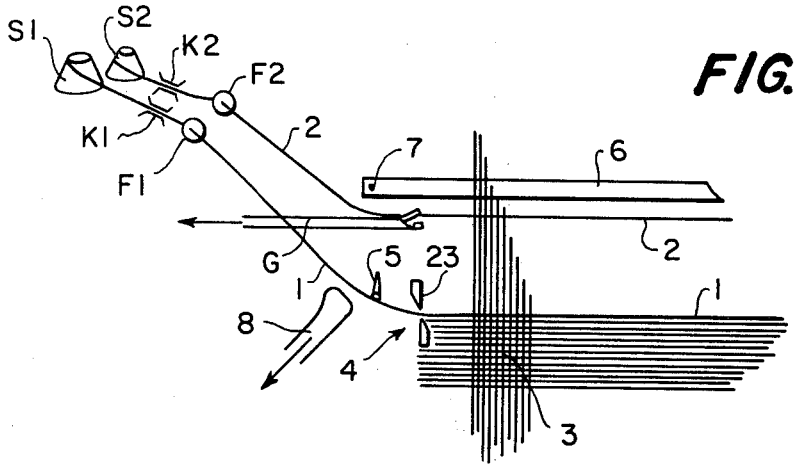

First those components will be described, in a general manner, in FIG. 1*a* that are shown in the other Figures. A length of fabric 3 is crudely indicated, crossing fillings and warps. A filling 1 is emphasized by a thicker line and is beat-up against the fabric 3 by the previous filling insertion. This filling 1 passes from the cloth over a thread guide F1 and a brake or clamp K1 to the supply spool S1. A second filling, and in fact the one last inserted, also is emphasized by a thicker line and denoted by 2. This filling 2 is not yet beat-up. It passes through an associated thread guide F2 and a brake or clamp K2 to its associated supply spool S2. The thread guides F1 and F2 can be displaced about normal to the fabric length and simultaneously act as thread-tendering needles to feed the new fillings to be inserted to the gripper. The gripper arms G are provided in this case as seizing or filling insertion devices, which comprise, at their front end, known clamping systems and not described more specifically here. The gripper arm G in FIG. 1*a* is retracted in the direction of the arrow and has just come out of the shed. The clamping device at the end of the gripper arm is shown open. If required or appropriate, known thread withdrawing arms may be mounted between the thread guides F1 and F2 on one hand and clamps K1 and K2 on the other, but these are not shown here because they are not essential. FIG. 1*a* furthermore shows the reed 6 with a diagrammatically represented finger 7 mounted thereon. The scissors 4 for cutting off the fillings of the supply spool are indicated to the left and outside of the shed. A spatially fixed catching hook 5 is mounted to a machine part not further illustrated outside the scissors 4. This catching hook keeps the filling into the proper position for cutting. A holding system 8 for the free filling end of the filling still connected to the supply spool is mounted outside the catching hook 5. The fillings cut off by scissors 4 project like brushes from the edge of the cloth 3. For the sake of clarity, the projecting ends are shown exaggeratedly long; in actuality the scissors 4 are mounted close to the edge of the fabric 3.

Figure 1C:
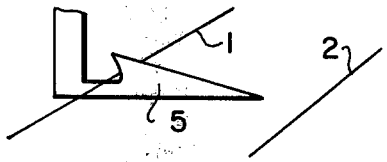
Figure 1B:
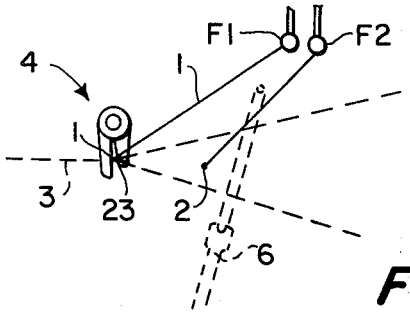

The shed is shown in dashed lines in a side view in FIG. 1*b* together with the finished length of cloth 3. The scissors 4 are located at the tip of the shed. The movable scissor blade facing the shed is denoted by 23. The position of the reed 6 also is shown in dashed lines. The thicker fillings 1 and 2 of FIG. 1*a* are shown here as points 1 and 2 from each of which the filling is guided in the form of a line to the thread guides F1 and F2. Rods moving upwardly are indicated at the eyelets of the thread guides F1 and F2, indicating their properties as thread tendering needles. These thread guides F1 and F2 are placed in front of the gripper by means of their rods or needles for the purpose of advancing the filling.

The process of beating up and cutting off the fillings now will be described in their time-sequence with reference to FIGS. 1 through 5.

FIG. 1 shows that instant when a previously inserted filling 1 already has been beaten up. This thread 1 passes between the two blades of the scissors 4 and is kept by the catching hook 5 in the position suitable for cutting-off. The clamp K1 between the thread guides F1 and F2 is closed. A second filling 2 has just been inserted and lies in front of the reed 6 in the shed. The gripper rod G moves in the direction of the arrow to the left and out of the shed. The filling 2 passes through the thread guide F2 and the open clamp K2 to the supply spool S2. Both thread guides F1 and F2 are in the lifted position. The filling 2 soon will be beaten up by the reed 6 against the fabric.

Figure 2B:
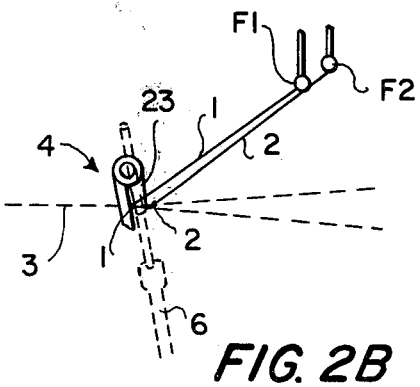
Figure 2A:
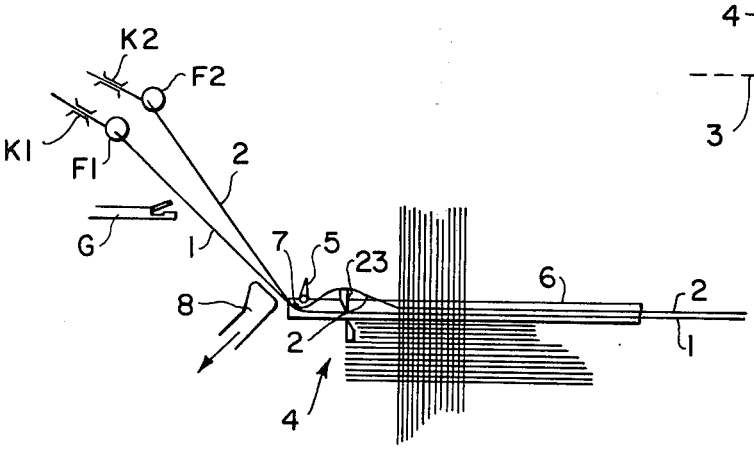

The reed 6 has moved forward in FIG. 2 and has beaten up the filling 2. The shed itself is nearly closed. As shown by the dot in FIG. 2*b*, the filling 2 passes over the back of the scissor blade 23 and is inserted by the finger 7 at the reed 6 into the catching hook 5. The filling 2 therefore so-to-speak loops the back of scissor blade 23 outside of the fabric. FIG. 2 shows the beginning of the insertion of the filling 2 into the catching hook 5. The finger 7 mounted to the reed 6 guides the filling 2 over the take-up ramp of the catching hook 5. FIG. 2*c* shows the thread 2 completely inserted into the catching hook 5 by the finger 7. When the finger 7 together with the reed 6 returns to its initial position, the filling 2 together with the filling 1 remains held in the slot of the catching hook 5. Both clamps K1 and K2 in front of the supply spools S1 and S2 are now closed.

The next step is shown in FIG. 3. The reed 6 is going back to its initial position. The scissors 4 are closed and the thread 1 is cut off. The free filling end 1' is held by the holding system 8. This holding system 8 is designed as a suction nozzle. The arrow indicates the direction of the suction. The clamp K1 in front of the supply spool is closed. In this manner the filling 1 can be held taut by the holding system 8. The filling 2 still remains looping the back of the scissor blade 23, as clearly shown by FIGS. 3*a* and 3*b*. Furthermore, the filling 2 is held by the catching hook 5 and passes through the thread guide F2 and the closed clamp K2 to the supply spool S2. The gripper arm G is wholly retracted and ready with the open clamp at the tip thereof to seize the next filling.

FIG. 4 shows the reed 6 completely retracted into its initial position. As shown by FIG. 4*b*, the scissors 4 are lifted vertically in the direction of the arrow toward the length of cloth 3 and are again open. Thereby the filling 2 drops from the back of the scissor blade 23 into the space between the two opened blades. The second and fixed scissor blade is longer than the movable blade 23 facing the shed and, despite the lifting of the entire scissors 4, remains with its ends still below the length of cloth 3. Therefore, the filling 2 comes to rest in front of the cutting edge of this fixed scissor blade. The thread guide F1 has been lowered in the direction of the arrow and has fed the filling 1 to the gripper arm G now advancing rightwardly. The clamp at the tip of the gripper arm G is open, seizes the filling end 1' and draws it out of the holding system 8. The clamp K1 for the filling 1 remains closed for a short while yet. Therefore, the filling is pulled by its end 1' through the still open clamp at the gripper arm. The gripper will close completely, and the thread will be solidly held only when a very short length of thread end 1' projects from the gripper's clamp. Simultaneously, the clamp K1 in front of the supply spool S1 is opened and the filling 1 can be withdrawn. The opening and closing processes of the clamp at the gripper arm are known and are not explained further herein, the gripper control being no part of the present invention.

Figure 5B:
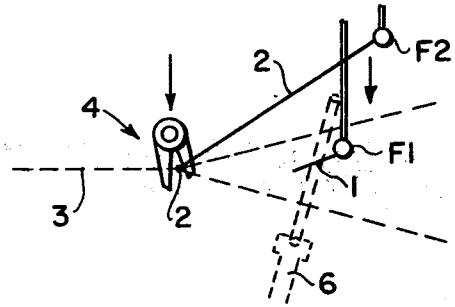

FIG. 5 shows the gripper arm G advanced deeply into the shed. Only a minute thread end 1' projects from the tip of its clamp. The filling 1 is withdrawn through the thread guide F1 and the open clamp K1 from the supply spool S1. The thread guide F1 still is in its lowered position for feeding the filling as shown by the direction of the arrow. The scissors 4 meantime have been lowered again in the direction of the arrow and have returned to the initial position of FIG. 1. Hence, a new filling 1 is inserted and prepared for beating up. The filling 2 from the prior filling insertion now is in the position for cutting between the open scissor blades. The process explained in relation to FIG. 1 may now again be repeated.

There is an essential circumstance as regards the process of the invention, namely that when cutting, a thread is first made to pass on the back of the scissor blade and is brought between the blades' cutting edges only at a later time, to be cut off only upon beating up the next filling. The cutting process need not be simultaneous with the beating up, but also may be carried out briefly after beating up. The different fillings 1 and 2 may be of the same or different kind or color. Therefore weft-mixer operation is possible. Only a single holding device is required to that end, which is spatially fixed. Crossing of the sequentially alternating and inserted fillings need not be feared.

Equipment in simplified representation for implementing the process will now be described with reference to FIGS. 6 through 8. An arm 11 is pivotally supported on a bearing 12 fastened to the machine. A freely rotatable roller 13 is mounted to the approximate center of the arm. This guide roller 13 rests against an eccentric 15. The eccentric 15 is coupled by means of a shaft 17 to the machine drive. The arm 11 and guide roller 13 are kept constantly in contact with the eccentric 15 by a spring or similar component, not described further. Upon rotation of the eccentric 15, the arm 11 is alternatingly raised and lowered. The raised upper position of the arm 11 is shown in solid lines. The eccentric 15 is coupled in such a manner with the drive of the weaving machine that it carries out the lifting motion of the arm 11 in dependence upon the beating-up motion of the reed 6.

The scissors generally denoted by 4 are mounted at the front end of the arm 11. These scissors are composed of one fixed scissor blade 21 and of a movable one 23. The blade 21 may be adjusted in the horizontal direction by means of the lengthwise slot 22 and the screws 19. The movable blade 23 rotates about one of screws 19. As a function of the eccentric 15, the scissors 4 together with the arm 11 execute a vertical reciprocating motion with respect to the cloth, not shown here. This motion takes place in a plane normal to the cloth. The length of the fixed blade 21 and the raising of the scissors between the upper position in solid lines and the lower one 21' in dashed lines are so computed that the lowermost end of the blade 21 never exceeds the height of the filling held by the catching hook 5. The lower end of the fixed blade 21 therefore remains constantly underneath the length of cloth. When the scissors 4 are in the raised position (as shown in FIG. 4*b*), the filling 2 passes through the clear space between the cutting edge of the fixed blade 21 and the slot of the catching hook 5. The mounting to the machine of the catching hook 5 is indicated in phantom.

Figure 8:
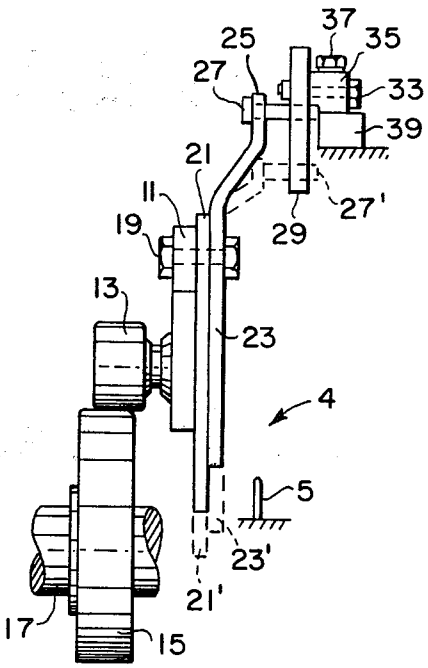
FIG. 8 shows the equipment of FIG. 6 in a front view and FIG. 9 is a perspective view of the left part of a complete weaving machine in accordance with the invention.

The movable scissor blade 23 is designed as a two-arm lever with a square upper tip, as shown in particular in FIG. 8. A guide pin 27 is mounted at the upper end 25 of the two arm lever of the movable blade 23. When the scissors move down, this guide pin 27 is guided in the guide part 41 of a plate 29 and in this manner is brought into position 27'. Not only is the movable blade 23 being lowered, but simultaneously it is being pivoted about a screw 19, so that the scissors 4 close. The closed position of the scissors is shown in dashed lines with the parts 21' and 23' in FIG. 6. The plate 29 is connected, by means of the slots 31 and the screws 33 and the slots 36 and the screws 37 in the intermediate piece 35, with the support 39 which is fastened to the machine. Therefore the plate 29 is displaceable in two dimensions and the motion of the scissor blade 23 may be adjusted as needed. The course of guide part 41 is determining with respect to the time when the scissors 4 close and reopen. If appropriate, not only may the plate 29 be displaced, but also various plates 29 with different slots may be mutually exchanged, so that the lifting and cutting motions of the scissors may be adjusted according to the individual requirements.

Figure 7:
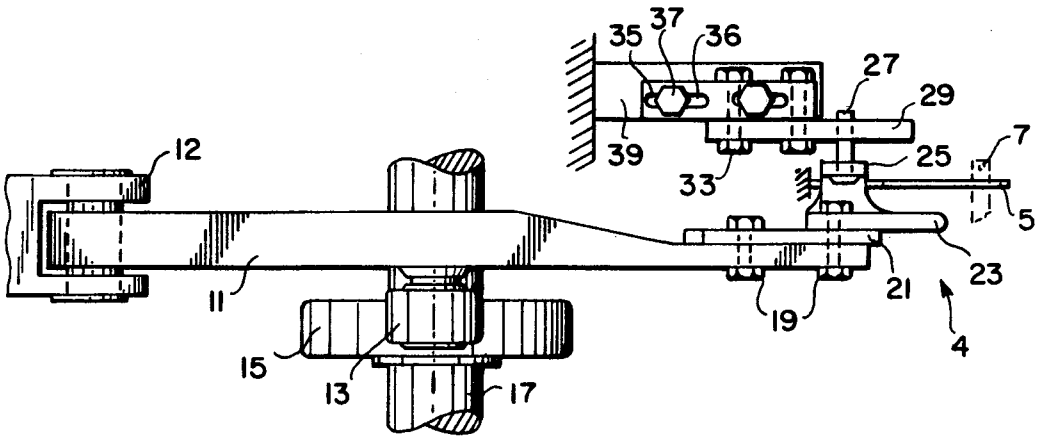
FIG. 7 shows the equipment of FIG. 6 in a top view.
Figure 6:
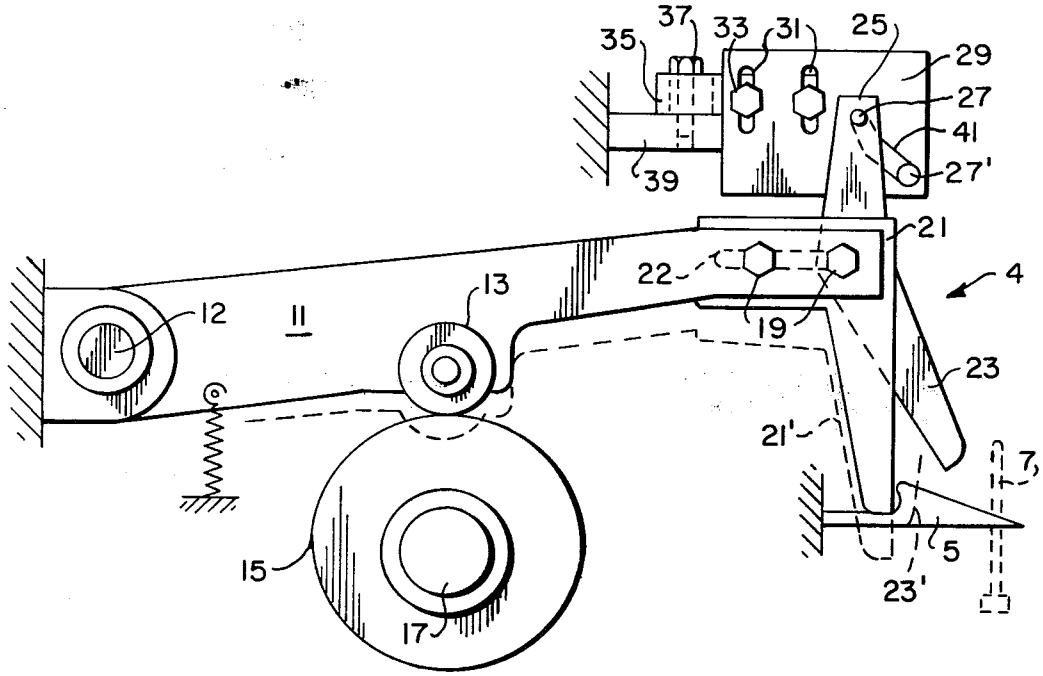
FIG. 6 is a simplified representation of equipment for implementing the process, in side view.

The catching hook 5 is mounted solidly to the machine between the scissors 4 and the holding system, omitted from representation in FIGS. 6 through 8 The take-up ramp of the catching hook 5 is shown in FIG. 6. This ramp is inclined with respect to the shed. The finger 7 shown in dashed lines in FIGS. 6 and 8 moves past it and is, as already mentioned, connected with the reed and upon the reed's beat-up motion moves the last inserted filling over the ramp behind the catching hook 5. The holding system 8 may be of arbitrary design, although the tentative design as a suction nozzle shown in FIGS. 1 through 5 was found very advantageous.

Figure 9:
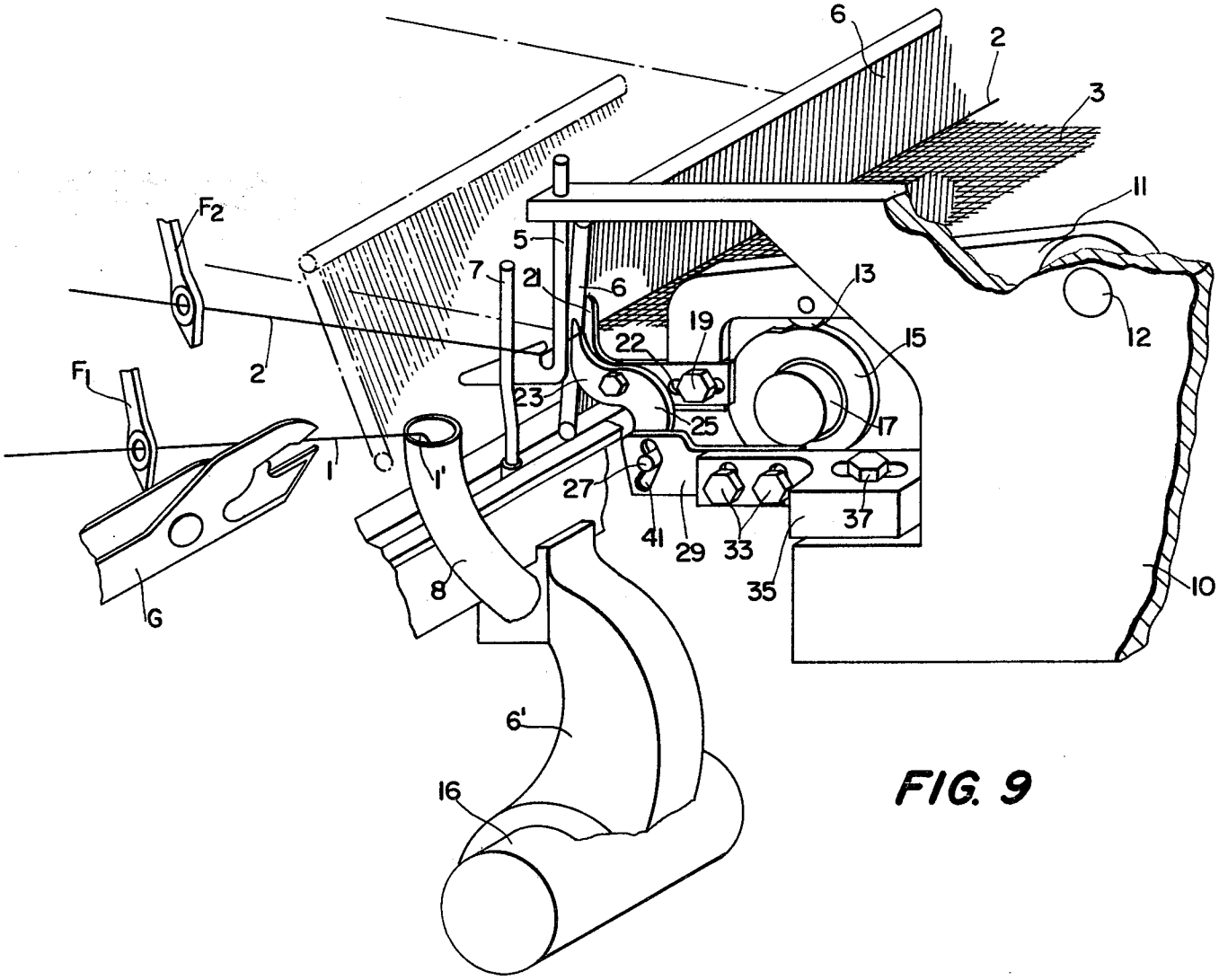

The individual components having been discussed in relation to FIGS. 1 through 8, and the assembly of a weaving machine comprising the parts of the invention having been described, this assembly now will be shown in the simplified perspective view of FIG. 9.

This FIG. 9 shows the left part of the machine component in a view slanted from above. The same reference numerals are used in FIG. 9 for the same components shown in the previous figures. FIG. 9 involves a variation to the extent that the scissor, unlike the case shown in FIG. 6, where it is displaced from above in the vertical direction, here is displaced from below in the vertical direction. Also, FIG. 9 shows the components in an opposite position corresponding approximately to the operational phase shown in FIG. 3.

A part of the machine frame 10 can be seen to the right of FIG. 9. The pivoting arm 11 is supported at 12 in that part of the frame. The drive shaft for the eccentric 15 is indicated at 17. By means of the eccentric 15 and the roller 13 which is supported in the arm 11 to be freely rotatable, this arm receives its lifting motion. The catching hook 5 is located at a protruding arm of the machine frame 10. The machine frame furthermore supports the control plate 29 which can be adjusted in its position and includes the guide part 41 for the pin 27 guided therein. These two pieces implement the opening and closing of the scissor blades 21 and 23 by means of the arm 25 of the movable scissor blade 23 when the arm 11 moves up and down.

Part of the shaft 16 may be seen at the bottom of FIG. 9 on which the reed 6 is pivotally supported by means of the arm 6'. The reed is shown in solid lines in a position approximately corresponding to the case of beat-up. The rest position of the reed 6 is indicated to the left in phantom. Again the warps are shown in dash-dot lines through the reed, these warps together forming the shed. The finished fabric is denoted by 3. The last inserted filling yarn 2 leads to the beat-up point at the fabric 3 over the back side of the movable scissor blade 23 through the catching hook 5 and around the finger 7 to the thread guide F2 and from there to the supply spool (not shown).

The other filling yarn, namely filling yarn 1, is drawn through the thread guide F1. Its free end 1' is held by the holder 8 have designed as a suction nozzle. The gripper G is open and ready to grip the filling yarn 1 and to insert it into the shed.

The described process makes it unnecessary to provide two separate holding systems for the free filling end in weft mixers. It is further unnecessary to make the holding system movable for the purpose of alternatingly bringing the filling end required at the particular time into the proper position in front of the gripper for the next filling insertion. A catching selvage at the cloth edge is unnecessary.

It will be obvious to those skilled in the art that many modifications may be made within the scope of the present invention without departing from the spirit thereof, and the invention includes all such modifications.

What is claimed is:

1. In the process for beating up and cutting off fillings inserted into the shed in shuttleless weaving equipment provided with a reed, scissors, and weft mixers, in particular in weaving machinery with filling insertion by means of grippers advancing into and retracting from the shed, the inserted filling being cut off on the insertion side outside the selvage, the improvement comprising that simultaneously with or following the beating up of the last inserted filling:

(a) closing the scissor blades to cut off the previously inserted filling and seizing the free end, connected to a supply spool, by a holding system, (b) guiding a portion of the last inserted filling over the back of a scissor blade to a catching hook mounted outside the scissors, the back of said scissor blade facing the reed, (c) simultaneously with the back-motion of the reed, displacing the scissors transversely to the direction of the filling in an orthogonal plane and reopening them, the last inserted filling passing from the back of the scissor blade to the front of the other scissor blade and into the cutting position determined by the catching hook, and (d) moving back the scissors into its initial position with the last inserted filling between the opened scissor blades.

2. Apparatus for beating up and cutting off fillings inserted into the shed in shuttleless weaving equipment provided with weft mixers, in particular in weaving machinery with filling insertion by means of grippers advancing into and retracting from the shed, the inserted filling being cut off on the insertion side outside the selvage, comprising (a) control means for scissor means, said control means imparting to said scissor means the cutting motion and an additional motion in a plane orthogonal to the cloth and to the direction of motion of the filling, as a function of the motion of a reed, (b) catching hook means mounted on the machine outside said scissor means for that part of the inserted filling leading to supply spool means, (c) means movable together with said reed for inserting the last inserted filling into said catching hook means, and (d) holding system means for seizing the free end of a filling connected to a supply spool means.

3. Apparatus according to claim 2 in which said control means includes a pivotally supported and vertically reciprocatable arm coupled by an eccentric cam means with a drive for the apparatus, and said scissor means including a blade rigidly connected with said arm and a second blade movably connected with said arm at the free end of said arm.

4. Apparatus according to claim 3 including means mounting said scissor means on said arm in an adjustable manner.

5. Apparatus according to claim 3 including extension means on said movable blade, said extension means being adapted to be guided in a guide element which controls the motion of the scissors as a function of the vertical reciprocating motion of said arm.

6. Apparatus according to claim 5 including means mounting said guide element in an adjustable manner.

7. Apparatus according to claim 3 including means mounting said movable blade of said scissor means toward the shed and raising said movable blade above the height of said cloth from a position underneath said cloth upon an upward motion of said arm, and said rigidly connected blade being of a length such that if extends as far as underneath the length of cloth for any position of said arm.

8. Apparatus according to claim 2 including means mounting said catching hook means between said scissor means and holding system means and being provided with a take-up ramp toward the shed for the filling.

9. Apparatus according to claim 2 including finger means mounted on said reed on a side of said scissor means away from said catching hook means.

10. Apparatus according to claim 2 in which said holding system means is a suction nozzle.

* * * * *